US007140150B2

(12) United States Patent
Sakai et al.

(10) Patent No.: US 7,140,150 B2
(45) Date of Patent: Nov. 28, 2006

(54) OPENING-CLOSING DEVICE FOR AN OPENING-CLOSING MEMBER OF A VEHICLE

(75) Inventors: Toshiyuki Sakai, Kariya (JP); Takeshi Yamamoto, Takahama (JP); Hiroji Ikeda, Nagoya (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 152 days.

(21) Appl. No.: 10/829,429

(22) Filed: Apr. 22, 2004

(65) Prior Publication Data

US 2005/0001444 A1 Jan. 6, 2005

(30) Foreign Application Priority Data

Apr. 23, 2003 (JP) ..... 2003-118751

(51) Int. Cl.
*E05F 11/24* (2006.01)

(52) U.S. Cl. ..... 49/340; 49/339; 296/56; 192/83

(58) Field of Classification Search ..... 49/339, 49/340, 341, 342, 140, 39; 296/56; 74/83, 74/84.9, 89.2
See application file for complete search history.

(56) References Cited

U.S. PATENT DOCUMENTS 5,896,703 A * 4/1999 Wright et al. ..... 49/339
6,092,336 A * 7/2000 Wright et al. ..... 49/339
6,367,199 B1 * 4/2002 Sedlak et al. ..... 49/340
2003/0079413 A1 5/2003 Fukumoto et al.
2004/0245064 A1 12/2004 Schachtl et al.

FOREIGN PATENT DOCUMENTS

| | | |
|---|---|---|
| DE | 40 21 310 A1 | 1/1992 |
| EP | 1 148 202 A2 | 10/2001 |
| GB | 890413 | 2/1962 |
| JP | 2003-41853 | 2/2003 |
| WO | 03/036119 A1 | 5/2003 |

OTHER PUBLICATIONS

★Nobuhiko Takeda et al., "Opening and Closing Control System for Opening-Closing Member of Vehicle", 10/722,400, filed Nov. 28, 2003.

* cited by examiner

*Primary Examiner*—Jerry Redman
(74) *Attorney, Agent, or Firm*—Buchanan Ingersoll & Rooney PC

(57) ABSTRACT

An opening-closing device includes a driving source, an opening-closing mechanism for opening and closing an opening-closing member provided at a vehicle body by operation of the driving source, and a clutch positioned between the driving source and the opening-closing mechanism and sifting an energization state can transmit a driving force of the driving source to the opening-closing mechanism and a non-energization state can not transmit the drive force. The clutch includes a drive portion and a driven portion. The drive portion and the driven portion contact each other by a first load which can transmit the driving force from the driving source to the opening-closing mechanism when the clutch is the energization state. The drive portion and the driven portion contact each other by a second load which can not transmits the driving force from the driving source to opening-closing mechanism when the clutch is the non-energization state.

12 Claims, 7 Drawing Sheets

OPENING-CLOSING DEVICE FOR AN OPENING-CLOSING MEMBER OF A VEHICLE

This application is based on and claims priority under 35 U.S.C. § 119 with respect to Japanese Patent Application No. 2003-118751 filed on Apr. 23, 2003, the entire contents of which are incorporated herein by reference.

FIELD OF THE INVENTION

The present invention relates to an opening-closing device for opening and closing an opening-closing member of a vehicle.

BACKGROUND OF THE INVENTION

A known opening-closing device is used as an opening-closing device for a backdoor (as a tailgate) of a vehicle as described in Japanese Patent Laid-Open Publication No. 2003-41853. With the known opening-closing device, the backdoor is opened both electrically and manually. The known opening-closing device described in Japanese Patent Laid-Open Publication No. 2003-41853 includes an electromagnetic clutch. When the backdoor is electrically operated to open and close, the electromagnetic clutch is energized for transmitting a rotational force of an actuator including an electric motor and a deceleration mechanism to an opening-closing mechanism connected to the backdoor. In the meantime, with the known opening-closing device, when the backdoor is manually operated to open and close, the transmission of the rotational force is cut by disengaging a transmitting member included in the electromagnetic clutch and a transmitted member from each other so that the backdoor is opened and closed without being affected by the resistance generated by the transmission of the reverse rotational force from the opening-closing mechanism side for rotating the actuator in reverse. For example, the known opening-closing device described in Japanese Patent Laid-Open Publication No. 2003-41853 includes a spring affecting the transmitted member to be disengaged from the transmitting member.

With the foregoing known construction, the transmitted member has to be attracted to the transmitting member with the strong force against the biasing force of the spring so that the rotational force is transmitted by the electromagnetic clutch when transmitting the rotational force of the actuator to the opening-closing mechanism. Thus, the known construction increases the size of the electromagnetic clutch. In the meantime, because the spring is configured to transmit the rotational force and to disengage the transmitted member from the transmitting member, the construction of the spring assumes complicated, which increases the manufacturing cost.

A need thus exists for an opening-closing device which includes an electromagnetic clutch with small and simple construction.

SUMMARY OF THE INVENTION

In light of the foregoing, the present invention provides an opening-closing device, which includes a driving source, an opening-closing mechanism for opening and closing an opening-closing member provided at a vehicle body by operation of the driving source, and a clutch positioned between the driving source and the opening-closing mechanism and sifting an energization state can transmit a driving force of the driving source to the opening-closing mechanism and a non-energization state can not transmit the drive force. The clutch includes a drive portion and a driven portion. The drive portion and the driven portion contact each other by a first load which can transmit the driving force from the driving source to the opening-closing mechanism when the clutch is the energization state. The drive portion and the driven portion contact each other by a second load which can not transmits the driving force from the driving source to opening-closing mechanism when the clutch is the non-energization state.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

DETAILED DESCRIPTION OF THE INVENTION

Figure 1:
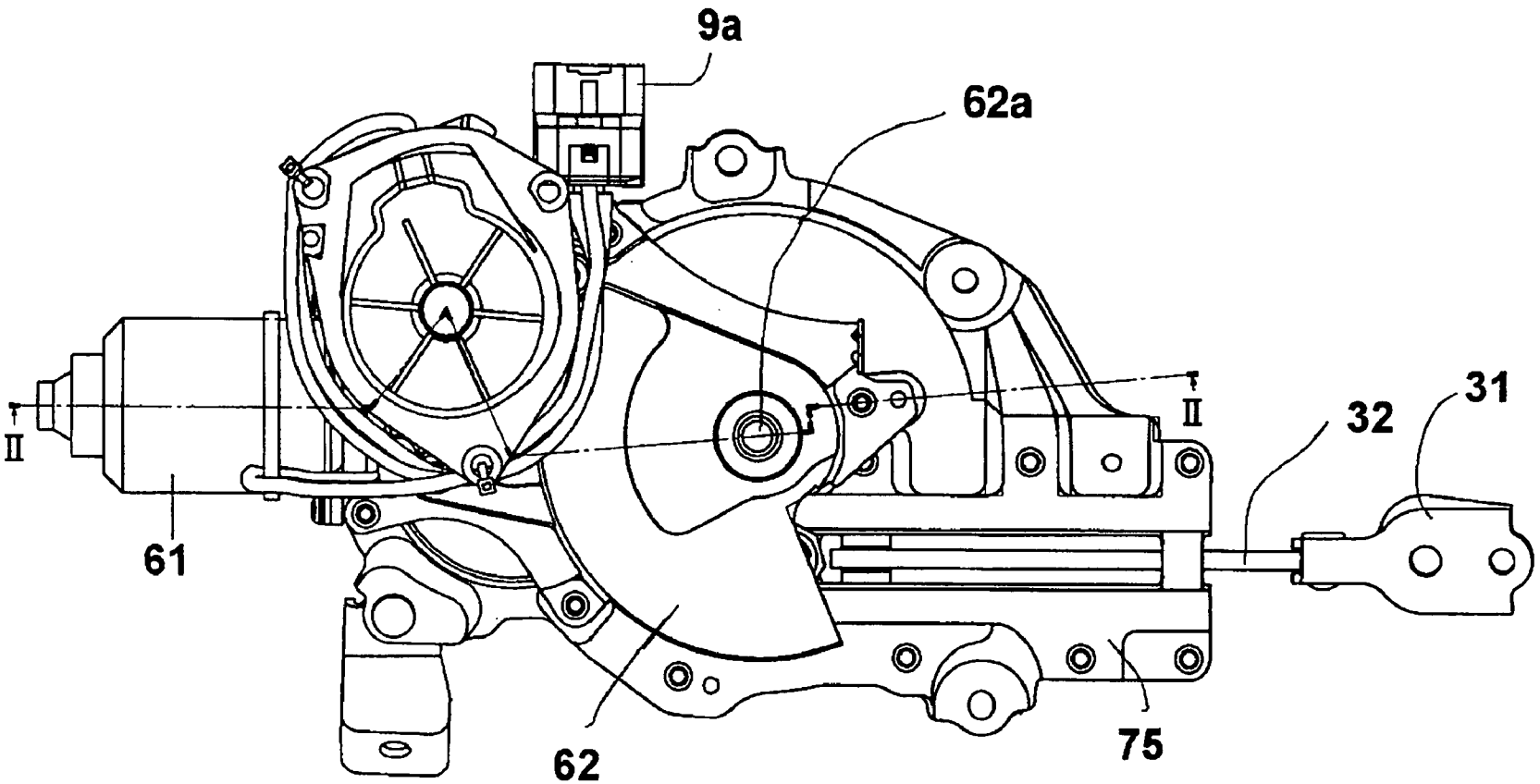
FIG. 1 shows a plane view of an opening-closing device according to a first embodiment of the present invention.

Embodiments of the present invention will be explained with reference to the illustrations of the drawing figures as follows.

A first embodiment of the present invention will be explained with reference to FIGS. 1–6. As shown in FIG. 6, an electric backdoor system 1 includes a backdoor (as a tailgate) 3 serving as an opening-closing body connected to an upper rear portion of a vehicle 2 with a hinge, an opening-closing device 6 for electrically operating the backdoor 3 to open and close, and a damper stay 5 serving as a device for generating the supplementary opening force.

The opening-closing device 6 includes an actuator 60 secured to a roof portion of the vehicle 2, an arm 32 extended from the actuator 60, and an opening-closing mechanism 30 including the arm 32 and a bracket 31 rotatably connected to the arm 32 and secured to the backdoor 3. By the electric operation of the opening-closing device 6, the backdoor 3 is selectively operated to close as shown with an actual line at FIG. 6 and to open as shown with a two-dotted chain line at FIG. 6. The damper stay 5 includes the construction of a gas piston enclosing the high pressure gas. A first end of the damper stay 5 is connected to a rear portion of the vehicle 2 and a second end of the damper stay 5 is connected to the backdoor 3. The damper stay 5 generates the load for assisting the opening of the backdoor 3 and for absorbing the shock when the door is suddenly opened.

Figure 2:
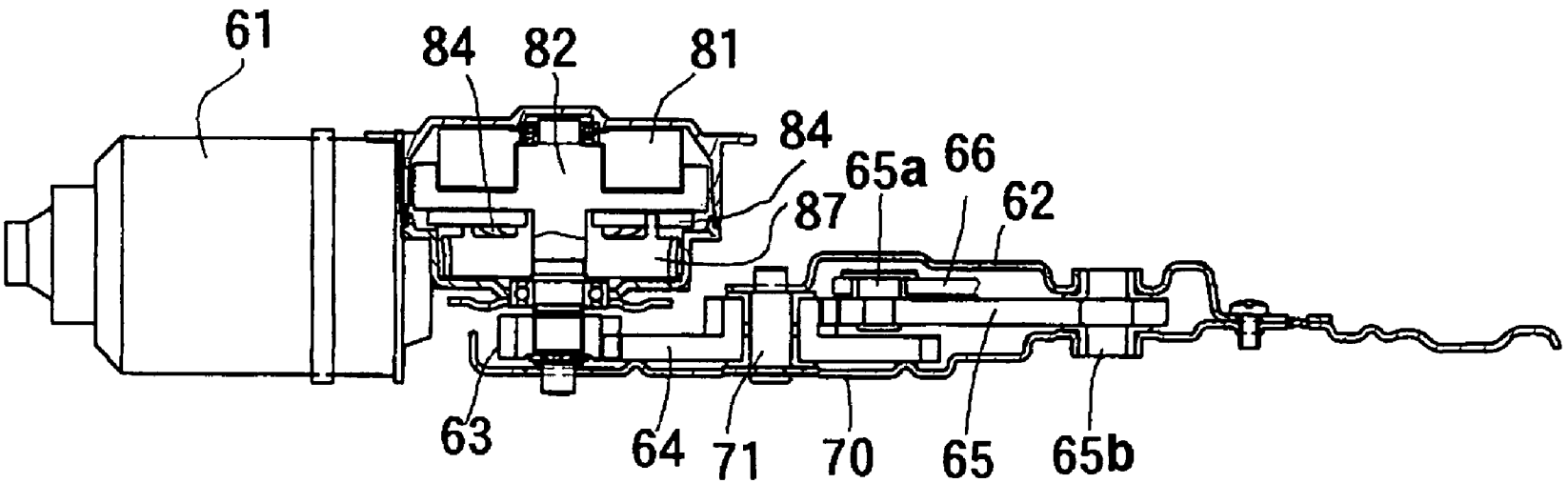
FIG. 2 shows a cross-sectional view taken on line II—II of FIG. 1.
Figure 3:
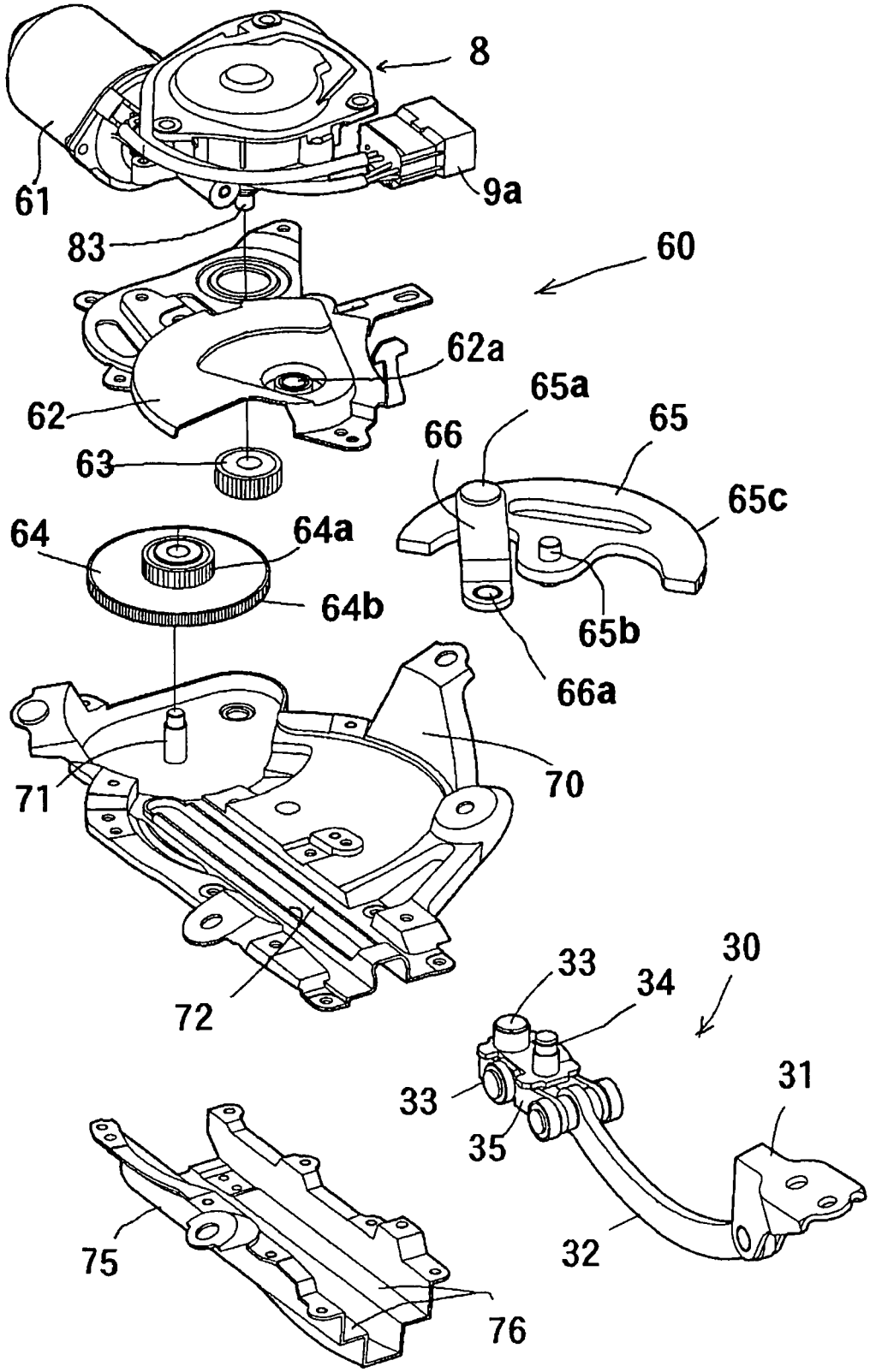
FIG. 3 shows an exploded perspective view of the opening-closing device according to the embodiment of the present invention.

Referring to FIGS. 1–3, the detailed construction of the actuator 60 and the opening-closing mechanism 30 will be explained as follows. The actuator 60 includes an electric motor 61 and an electromagnetic clutch 8 (shown in FIG. 3) for controlling the transmission of the rotational operation force of the electric motor 61 to the opening-closing mechanism 30. The actuator 60 further includes a first intermediate gear 63, a second intermediate gear 64 having large gear portion 64*b* geared with the first intermediate gear 63, and a crank gear 65 having a sector gear portion 65*c* geared with a small gear portion 64*a* unitarily formed with the second intermediate gear 64, which transmits the rotational force from the electromagnetic clutch 8 to the opening-closing mechanism 30. A rotational shaft 65*a* vertically extended in parallel with a rational shaft 65*b* of the crank gear 65 is provided at a surface of the crank gear 65. A first end of a link 66 is rotatably provided at a first end of the rotational shaft 65*a*. A hole 66*a* is formed at a second end of the link 66. A shaft 34 extended in the vertical direction is configured to be located at the hole 66*a*. A slider 35 unitarily formed with the shaft 34 is rotatably connected relative to the link 66.

A bottom housing 61*a* (shown in FIG. 4) is fixed to the electric motor 61. A lower case 70 and an upper case 62 shown in FIG. 3 are fixed to the bottom housing 61*a*. The first intermediate gear 63, the second intermediate gear 64, the crank gear 65, and the link 66 are accommodated in a space formed with the lower case 70 and the upper case 62 to be assembled to the electric motor 61. The upper case 62 includes a bearing portion 62*a* for supporting the rotational shaft 65*b* of the crank gear 65. The lower case 70 is provided with a rotational shaft 71 arranged to be extended upward for supporting the second intermediate gear 64.

A slide bracket 75 is attached at a bottom surface of the lower case 70. The slide bracket 75 includes a pair of horizontal slide surfaces 76 horizontally formed in the fore-aft direction of the vehicle 2. The lower case 70 includes a pair of vertical slide surfaces 72 formed at the vertical surface extended in the fore-aft direction in parallel with the horizontal slide surface 76.

In the meantime, a roller 33 rotating about a shaft vertically extended and provided at a top surface of the slider 35. Four rollers 33 rotating about each corresponding shaft extended in the horizontal direction are provided at sides of the slider 35. The roller 33 rotating about the vertically extended shaft rotates contacting the vertical slide surface 72 and the rollers 33 rotating about the horizontally extended shafts rotates contacting the horizontal slide surface 76 for guiding the slider 35 in the fore-aft direction of the vehicle 2.

With the construction of the embodiment, an output shaft 83 of the actuator 60 is fixed to the first intermediate gear 63 so that the electromagnetic clutch 8 transmits the rotational force of the electric motor 61. By actuating the electric motor 61, the slider 35 moves in the fore-aft direction to electrically open and close the backdoor 3 via the opening-closing mechanism 30.

Figure 4:
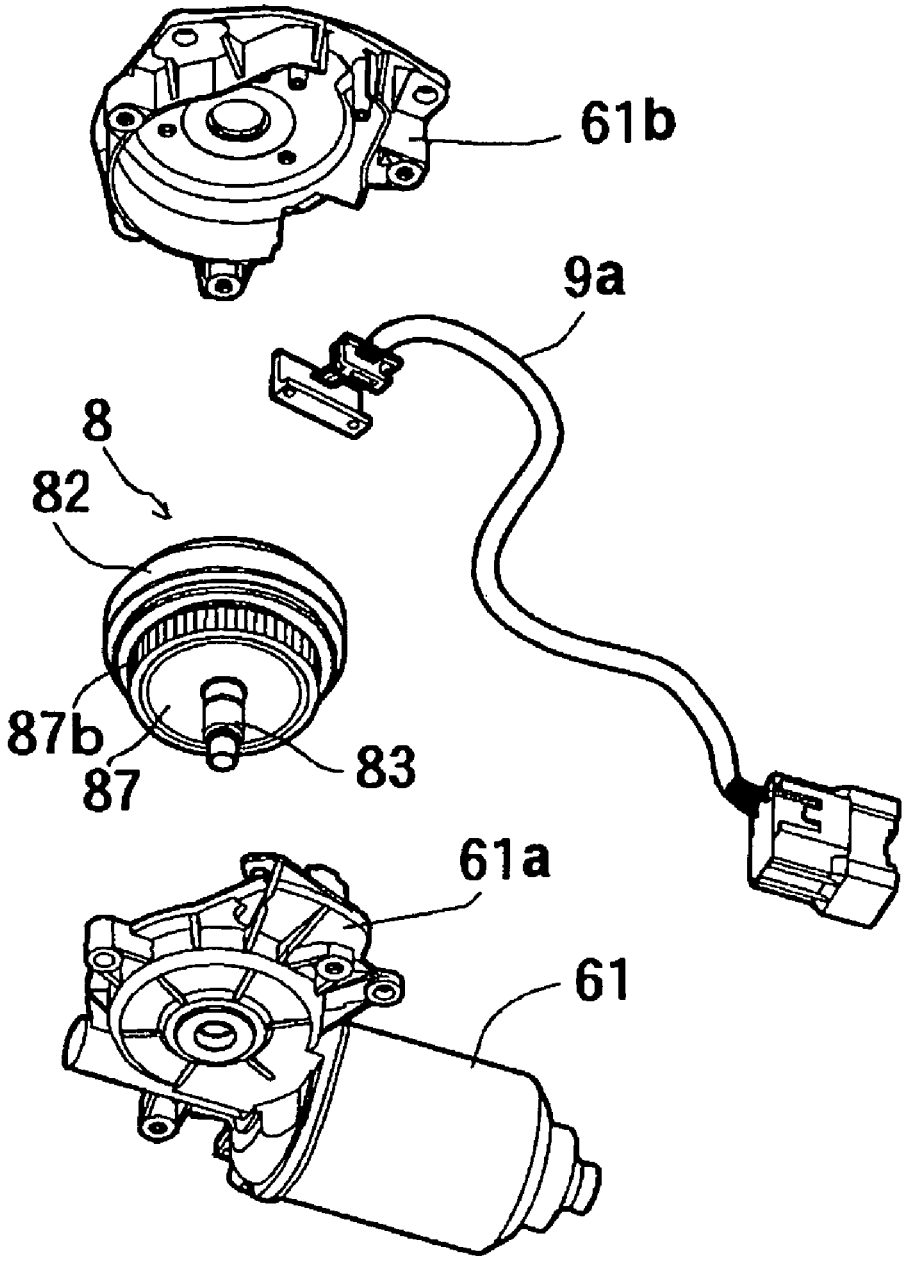
FIG. 4 shows an exploded perspective view of an actuator of the opening-closing device according to the embodiment of the present invention.

As shown in FIGS. 2–4, a top housing 61*b* is provided for covering the top of the bottom housing 61*a* of the electric motor 61 for forming the accommodation space with the bottom housing 61*a*. The electromagnetic clutch 8 is accommodated in the accommodation space.

Figure 5:
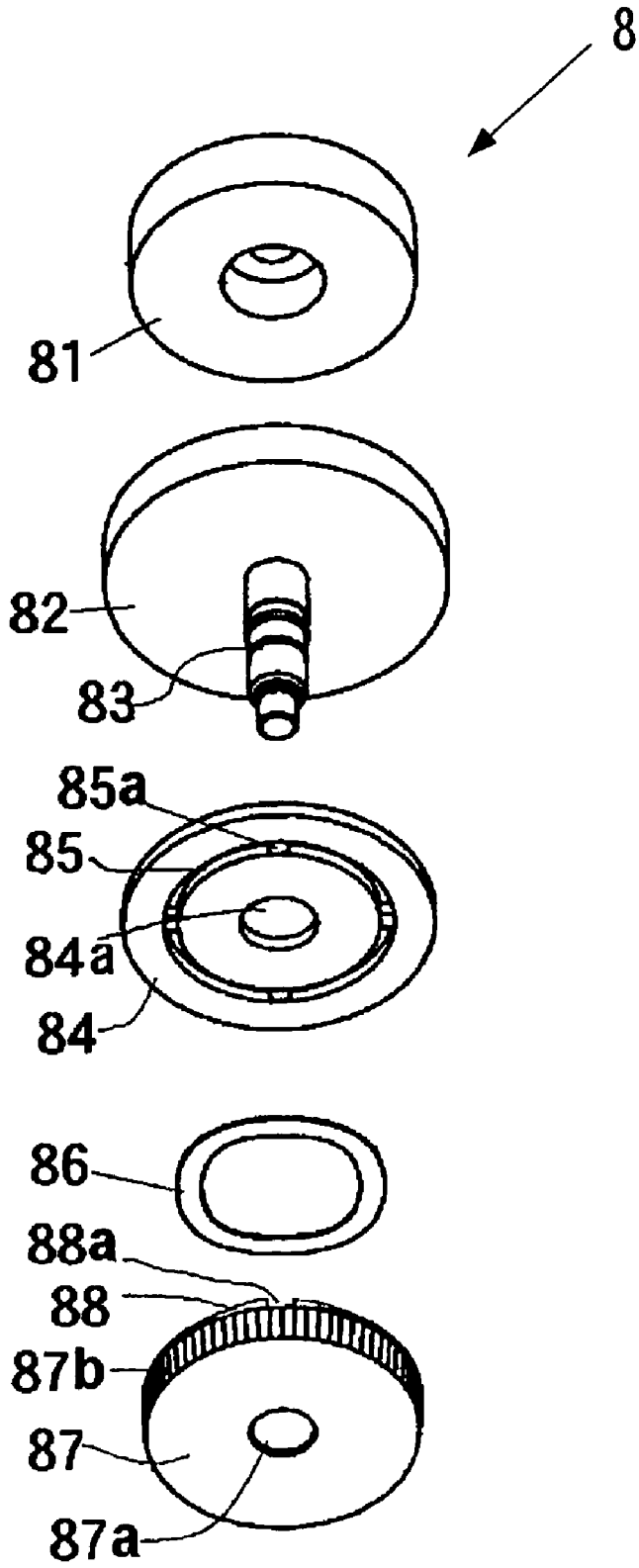
FIG. 5 shows an exploded perspective view of an electromagnetic clutch of the opening-closing device according to the embodiment of the present invention.
Figure 6:
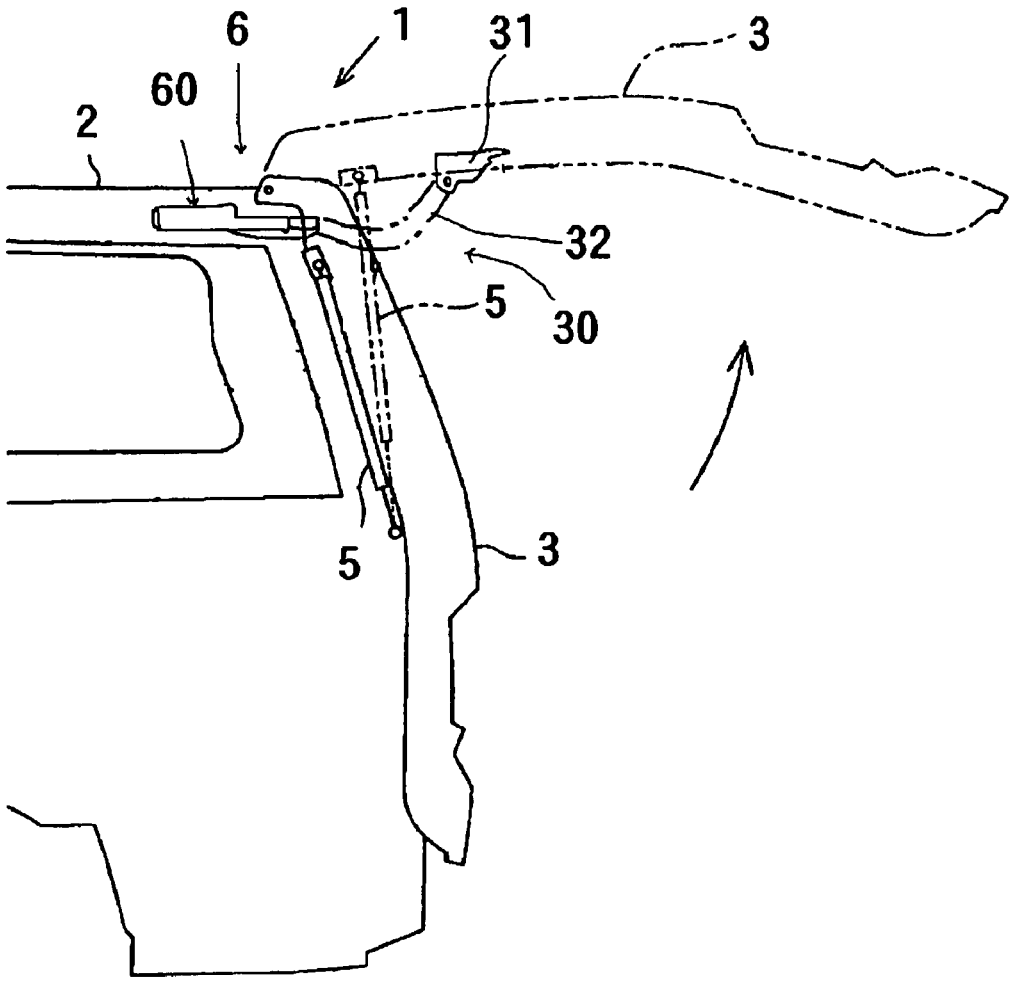
FIG. 6 shows a lateral view adapting the opening-closing device to an electric backdoor system of a vehicle.

As shown in FIG. 5, the electromagnetic clutch 8 includes and electromagnetic solenoid 81, a rotor 82 serving as a driven portion, a shaft 83 fixed at the center of the rotor 82 to be vertically extended, an armature 84 serving as a drive portion including a hole 84*a* to be filled with the shaft 83, a wave washer 86 serving as an elastic body for pushing the armature 84 to contact the rotor 82 with a predetermined load, and a worm wheel 87. A circular groove 85 is formed at the armature 84. A flange 88 is provided at the worm wheel 87 to fit in the circular groove 85. Plural recess portions 88*a* are formed at the flange 88. Plural detent portions 85*a* are provided at the circular groove 85 of the armature 84. The detent portions 85*a* are engaged with the recess portions 88*a* so that the relative rotation of the armature 84 and the worm wheel 87 is restricted while allowing the relative movement of the armature 84 and the worm wheel 87 in the axial direction. With this construction, the rotation is transmitted from the worm wheel 87 to the armature 84.

The worm wheel 87 is rotatably engaged with the shaft 83 at the hole 87*a* and includes a helical gear portion 87*b* at the external periphery thereof. The helical gear portion 87*b* is geared with a worm gear formed at an output shaft of the electric motor 61. Thus, the worm wheel 87 is rotated by the actuation of the electric motor 61.

With the electromagnetic clutch 8, the armature 84 is pushed to contact the rotor 82 by the wave washer 86 at the non-energization state, when the power is not supplied to the electromagnetic solenoid 81 from a harness 9*a* (shown in FIG. 4). Because the armature 84 is pushed to contact the rotor 82 with the predetermined load by the wave washer 86 at the non-energization state, the noise is not generated by the oscillation of the vehicle.

When the backdoor 3 is manually operated to open and close at the state that the electromagnetic clutch 8 is not energized, the rotational force from the backdoor 3 is transmitted to rotate the crank gear 65, the second intermediate gear 64, and the first intermediate gear 63. However, because the armature 84 of the electromagnetic clutch 8 contacts the rotor 82 with the predetermined light load the armature 84 and the rotor 82 slides each other so that the worm wheel 87 applied with the resistance of the electric motor 61 at the stopped state without the energization does not rotate. Thus, the backdoor 3 can be manually opened and closed with the light operational force.

Although the armature 84 and the rotor 82 slide each other accompanying the friction at the manual operation, the sufficient durability can be ensured for the opening-closing device of the backdoor. With this construction, even when the embodiment is applied to the special opening-closing device for the backdoor with frequent manual operation, the surface treatment for improving the duration for the abrasion may be provided at the armature 84 and the rotor 82 to ensure the durability.

In the meantime, when the electromagnetic solenoid 81 is energized, the armature 84 made of magnetic metal such as iron is attracted to the electromagnetic solenoid 81 side to contact the rotor 82 hard. Thus, the rotational force necessary for operating the backdoor 3 to open and close is transmitted from the armature 84 to the rotor 82.

The operation of the opening-closing device 6 for the electric backdoor system 1 will be explained as follows.

When the opening-closing device 6 receives the command to open the backdoor 3 by the operation of a remote control device, or the like, first, the power is supplied from the harness 9*a* to the electromagnetic solenoid 8 by a controller receiving the signal from the remote control device to establish the transmission path of the rotational force of the electric motor 61 for opening the backdoor 3. By supplying the power from the harness 9*a* to the electric motor 61, the electric motor 61 rotates to open the backdoor 3. The operation for closing the backdoor 3 is operated by rotating the electric motor 61 in reverse likewise the operation when opening.

In case the loading and unloading is conducted at a half open state of the backdoor 3, the backdoor 3 is operated manually to open and close. In this case, the backdoor 3 is operated likewise known backdoor systems which are not electrically operated.

Figure 7:
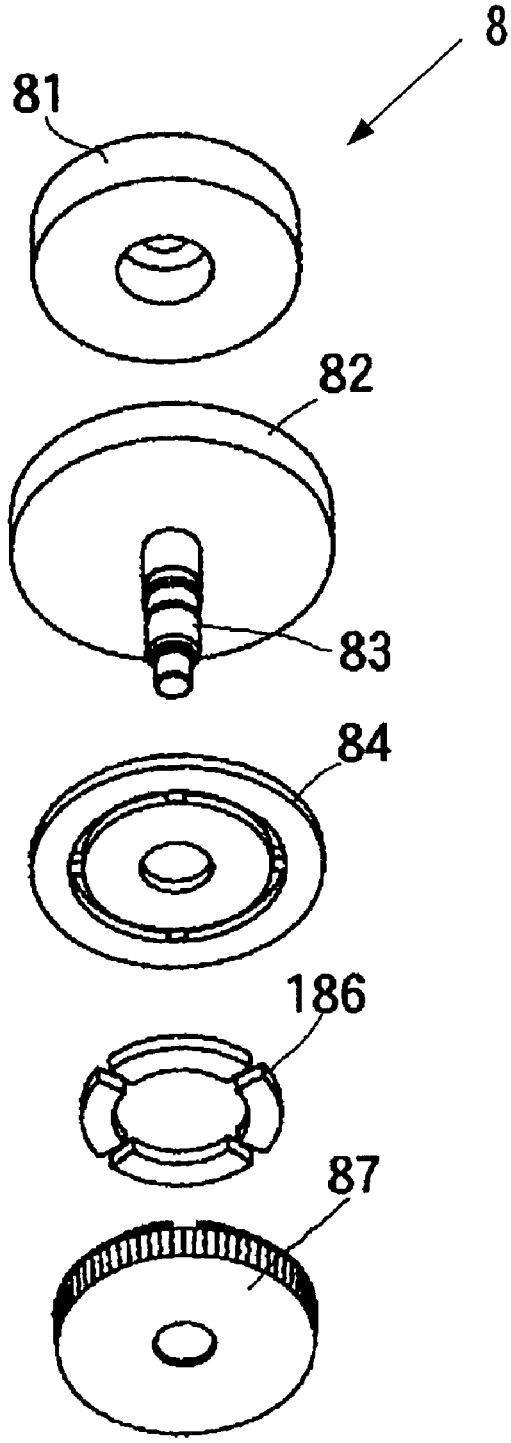
FIG. 7 shows an exploded perspective view of an electromagnetic clutch of an opening-closing device according to a second embodiment of the present invention.

A second embodiment of the present invention is shown in FIG. 7. As shown in FIG. 7, with an electromagnetic clutch according to the second embodiment, an elastic body 186 formed with resin foam member is used for pushing the armature 84 to contact the rotor 82 with the predetermined load. By gluing the elastic body 186 to the worm wheel 87, the assembling of the electromagnetic clutch becomes easy.

Although the embodiment of the present invention is explained by applying to the backdoor, the opening-closing device of the embodiment of the present invention is not limited to the application to the backdoor. The opening-closing device of the embodiment of the present invention may be applied to various doors including the backdoor, a side door, and a trunk lid, or the like. In terms of the opening-closing type of the doors, the opening-closing device of the embodiment of the present invention may be applied to a swing door and a slide door, or the like.

The principles, preferred embodiment and mode of operation of the present invention have been described in the foregoing specification. However, the invention which is intended to be protected is not to be construed as limited to the particular embodiments disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. An opening-closing device comprising:

a driving source;

an opening-closing mechanism for opening and closing an opening-closing member provided at a vehicle body by operation of the driving source;

a clutch positioned between the driving source and the opening-closing mechanism;

the clutch being shiftable between an energization state in which the clutch transmits a driving force of the driving source to the opening-closing mechanism and a non-energization state in which the clutch is unable to transmit the driving force of the driving source to the opening-closing mechanism;

the clutch includes a drive portion and a driven portion; wherein the drive portion and the driven portion contact each other by a first load which is able to transmit the driving force from the driving source to the opening-closing mechanism when the clutch is in the energization state; and wherein the drive portion and the driven portion contact each other by a second load which permits operation of the opening-closing mechanism to open and close the opening-closing member without the driving force of the driving source when the clutch is in the non-energization state, and the drive portion is pushed to contact the driven portion by an elastic member when the clutch is in the non-energization state.

2. The opening-closing device according to claim 1, wherein:

the elastic member is a wave washer.

3. The opening-closing device according to claim 1, wherein:

the elastic member is a resin foam member.

4. The opening-closing device according to claim 1, wherein the drive portion is an armature and the driven portion is a rotor, the elastic member being portioned so that the armature is positioned between the elastic member and the rotor.

5. The opening-closing device according to claim 1, wherein the drive portion is positioned between the elastic member and the driven portion.

6. The opening-closing device according to claim 1, wherein the clutch includes a worm wheel, the elastic member being positioned between the worm wheel and the drive portion.

7. An opening-closing device comprising:

a driving source;

an opening-closing mechanism for opening and closing an opening-closing member provided at a vehicle body by operation of the driving source;

a clutch positioned between the driving source and the opening-closing mechanism;

the clutch being shiftable between an energization state in which the clutch transmits a driving force of the driving source to the opening-closing mechanism to open and close the opening-closing member under the driving force of the driving source and a non-energization state in which the clutch does not transmit the driving force of the driving source to the opening-closing mechanism to permit the open-close member to be manually opened and closed;

the clutch including a drive portion connected to the driving source, a driven portion connected to the opening-closing mechanism, and an elastic member;

the drive portion and the driven portion being urged into contact with one another with a first load during the energization state of the clutch to transmit the driving force of the driving source to the opening-closing mechanism through the drive portion and the driven portion to open and close the open-close member under the driving force of the driving source;

the elastic member being positioned to apply an axial force pushing the drive portion and the driven portion into contact with one another under a second load in which the driven portion and the drive portion are relatively slidable during the non-energization state of the clutch to permit the open-close member to be manually opened and closed.

8. The opening-closing device according to claim 7, wherein the elastic member is a wave washer.

9. The opening-closing device according to claim 7, wherein the elastic member is a resin foam member.

10. The opening-closing device according to claim 7, wherein the drive portion is an armature and the driven portion is a rotor, the elastic member being portioned so that the armature is positioned between the elastic member and the rotor.

11. The opening-closing device according to claim 7, wherein the drive portion is positioned between the elastic member and the driven portion.

12. The opening-closing device according to claim 7, wherein the clutch includes a worm wheel, the elastic member being positioned between the worm wheel and the drive portion.

* * * * *